US007669846B1

(12) United States Patent
Hoover et al.

(10) Patent No.: US 7,669,846 B1
(45) Date of Patent: Mar. 2, 2010

(54) SELF LEVELING ELEVATOR PLATE FOR PAPER FEED TRAY

(75) Inventors: Linn C. Hoover, Webster, NY (US); Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/212,969

(22) Filed: Sep. 18, 2008

(51) Int. Cl.
*B65H 1/08* (2006.01)

(52) U.S. Cl. ..... 271/148

(58) Field of Classification Search ..... 271/147, 271/148, 127, 126
See application file for complete search history.

(56) References Cited

U.S. PATENT DOCUMENTS 3,260,521 A * 7/1966 Moxness ..... 271/116
5,419,645 A * 5/1995 Russo ..... 400/624
7,267,337 B2 * 9/2007 Moore et al. ..... 271/148
7,411,205 B2 * 8/2008 Amarakoon et al. ... 250/559.27
2006/0208414 A1 * 9/2006 Amarakoon et al. ..... 271/10.02
2007/0102870 A1 * 5/2007 Moore et al. ..... 271/152

* cited by examiner

*Primary Examiner*—David H Bollinger
(74) *Attorney, Agent, or Firm*—Fay Sharpe LLP

(57) ABSTRACT

Apparatus and method for controlling the slope angle of sheet stock in a feeder/loader for copying/printing where leading edge side of the stock is elevated by elevating one side of the support tray to position the top sheet for nudging into a nip. When the slope angle of the stock reaches a critical value, in one version, a separate elevating mechanism raises the opposite side of the support tray to prevent the slope angle from exceeding the critical value. In another version, the elevating mechanism for the opposite edge is connected to the elevating mechanism for the leading edge of the stack and raises the opposite edge when the sheet stock slope angle reaches a threshold value to prevent potential misfeed.

9 Claims, 4 Drawing Sheets

SELF LEVELING ELEVATOR PLATE FOR PAPER FEED TRAY

BACKGROUND

The present disclosure relates to feed trays or stackers for holding sheet paper stock from which sheets are progressively fed into a copier or printer. Feeders for paper sheet stock may have the deck plate or bottom of the tray elevatable as sheets are withdrawn from the stack to maintain the top sheet of the stack properly positioned for correct entry when moved by a nudger into the feeder entry such as a pair of nip rollers. A common method to elevate stacks for feeders such as friction retard feeders containing one ream of paper stock, typically less than 600 sheets, is to elevate only the one edge of the stack of sheet paper stock nearest to the feeder nip thereby reducing the forces required to elevate the entire stack and minimize the complexity of the elevating mechanism. However, single edge elevation of the feeder deck plate inherently results in a sloped/angled approach of the stack into the feeder nip. Where heavy weight paper sheet stock is being fed, this has resulted in the leading edge of the top sheet contacting the roller above the nip centerline which results in sheet stubbing and the downward bending of the leading edge whereby the normal and friction forces developed between the bent top sheet and the next sheet beneath results in dragging the next sheet into the nip causing a misfeed.

In addition, as sheets are withdrawn from the stack, the elevation mechanism must raise the leading edge of the stack progressively higher resulting in a greater sloped angle of approach of the stack to the feed nip. The increased angle has resulted in the leading edge of the top sheet striking the upper nip roller even higher and further causing sheet damage and more frequent misfeeds.

Therefore, it has been desired to provide a paper sheet stock feeder which has a cost effective elevatable bed plate or tray which can accommodate the weight of a large stack of paper sheet stock and particularly heavy weight sheet stock and elevate the stack so as to maintain the top sheet for proper nudging into the nip of the feeder in a manner which is not complex, does not require an elevating force equal to the weight of the entire stack and which aligns the leading edge of the top sheet with the centerline of the feed nip at an very low angle of approach as sheets are withdrawn from the stack.

Referring to FIGS. 3 and 4, a known arrangement for a sheet paper stock feeder or loader is illustrated where the stack of sheet paper stock indicated generally at 1 has the top sheet thereof moved by a nudger roller 3 frictionally engaging the top sheet and rotated in a counterclockwise direction as indicated by the curved arrow for propelling the sheet 2 into a feeder nip indicated generally at 4. A sheet guide, denoted by reference numeral 5, lifts the leading edge of the sheet 2 from the stack to position the leading edge properly for entry into the centerline of the nip as illustrated in FIG. 3 for a full stack of paper in the tray or bed plate 6.

Referring to FIG. 4, the device of FIG. 3 is shown with the lead side of the bed plate 6 adjacent the leading edge 2*a* of the sheet 2 elevated by a crank arm 7 which is lifted by a distance "Y" and forming a tilt or slant angle for the bed plate 6 denoted by the character "a" in FIG. 4. Thus, the leading edge 2*a* engages the upper roller 8 of the feeder nip 4 at a distance "y" above the centerline of the nip which results in the top sheet 1 being deflected downwardly into the nip. This downward deflection causes increased pinching and friction between the top sheet and the next adjacent sheet in the stack and often dragging the next sheet into the feeder nip thereby causing a misfeed. This problem is particularly acute with heavy weight paper stock because the bending force of the top sheet 1 is increased by the greater stiffness of the heavier sheet stock thereby resulting in substantial downward friction force on the next adjacent sheet; and, thus there is a high probability of misfeed when the angle "a" is sufficient to cause the leading edge 2*a* to engage the upper nip roller 8 so as to cause significant bending of the top sheet 1.

Thus, it has been desired to provide a way or means of implementing a sheet paper stock feeder tray which may be elevated economically by a mechanism raising only one side thereof but which eliminates the occurrence of misfeed when the tilt or slant angle of the stack, resulting from withdrawal of many sheets, increases to a point where the leading edge contacts the upper nip roll above the nip centerline resulting in substantial downward bending of the leading edge of the top sheet.

BRIEF DESCRIPTION

The present disclosure provides a feeder for sheet paper stock where the leading edge side of the elevator plate or tray is elevated by rotation to maintain the leading edge of the top sheet in proper position such that upon urging by a nudger roll, the leading edge of the top sheet of paper stock engages the centerline of the feeder nip in an associated feeder to prevent downward bending of the paper and frictional dragging of the next adjacent sheet into the nip and a resultant misfeed. The mechanism of the present disclosure provides for elevating the opposite side of the bed plate or tray, e.g., the trailing edge side, upon withdrawal of sheets from the stack, to a critical angle where heretofore the sloped angle of the stack would have normally caused the leading edge of the paper to strike the upper roll of the feeder nip above the nip centerline or common tangent plane and the resultant undesirable sheet bending. However, the presently disclosed mechanism causes the opposite or trailing edge of the bedplate to be elevated when the angle of slope of the stack reaches a critical value dependent on specific feeder roll geometry. In one embodiment, the mechanism for elevating the opposite or trailing edge side of the elevator plate or tray is driven independently from the elevating mechanism for the leading edge; and, in another embodiment the elevating mechanism for the opposite or trailing edge side of the elevator plate is connected to the elevating mechanism for the leading edge by a slotted link or similarly functioning mechanism which causes the trailing edge to be elevated after a threshold amount of elevation of the leading edge has taken place.

The feeder for sheet paper stock of the present disclosure thus responds to a threshold slope angle of the paper stack to prevent the angle from increasing to a point where deflection of the top sheet being fed would potentially cause misfeed from the stack.

DETAILED DESCRIPTION

Figure 1:
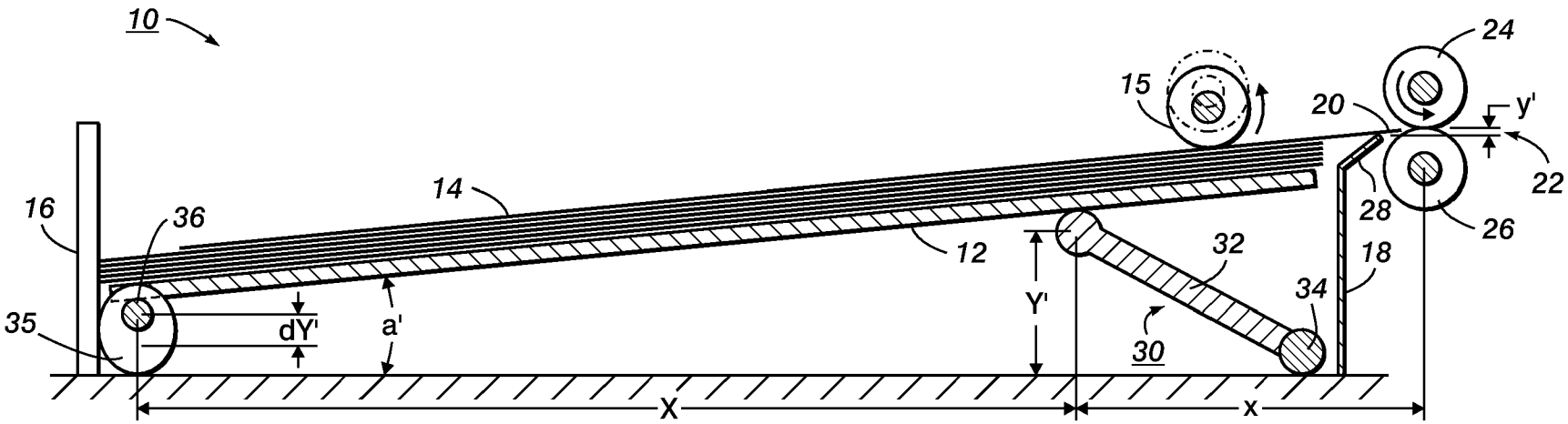
FIG. 1 is a side elevation view of a sheet paper feeder mechanism of the present disclosure in an embodiment employing individual elevator mechanisms for the leading edge and trailing edge sides of the stacker.

Referring to FIG. 1, a first embodiment of the feeder for sheet paper stock of the present disclosure is indicated generally at 10 and has a deck plate or tray 12 which is shown in the elevated condition with a few remaining sheets in the stack with the top sheet in the stack 14 being fed by a nudger roll 15 driven by a suitable drive motor (not shown). The stack is maintained in position on the deck plate 12 by edge guides 16, 18; and, the angle of tilt or slant is denoted by the reference character "a". The leading edge of the top sheet 14 is denoted by reference numeral 20 and is illustrated as being fed into a feeder nip indicated generally at 22 comprising upper nip roller 24 and lower nip roller 26. The leading edge 20 is shown as contacting the lower roll 26 by a distance "y'" below the centerline of the nip 22 over the sheet guide 28 provided on the upper edge of the guide 18. This results in a slight lifting of the leading edge 20 as it enters the nips and thus adequate separation of the top sheet from the next sheet below and thereby minimizes friction therebetween.

An elevator mechanism indicated generally at 30 is provided for elevating the leading edge of the bed plate or tray 12 and comprises a crank arm 32 pivoted about pin 34 by a drive motor (not shown) with the upper or movable end of the crank arm contacting the undersurface of the bed plate 12 at a distance "x" from the centerline of the nip rollers 24, 26. The amount of elevation of the leading edge side by crank arm 32 is denoted by the reference character "Y'" in FIG. 1. The opposite side or trailing edge side of the deck plate 12 is supported by a roller 35 having an eccentric cam pin 36 which, upon rotation of roller 35 by a suitable mechanism (not shown) such as a servo-motor is operative to elevate the trailing edge side of the deck plate amount "dY'" in response to a signal from an elevation sensor (not shown) for the leading edge.

The amount of lift required at the trailing edge or opposite side of the elevator plate required to lower the leading edge of the paper stock is proportional to the distance between the pivot and the crank "X" versus the distance from the crank to the feed nip centerline "x" as set forth in the expression $$dY'=y'(X+x).$$

In the present practice it has been found satisfactory or desirable to have the leading edge 20 of the top sheet 14 contact the lower nip roller 26 at a distance y' of about 1 mm below the centerline of the feed nip 22. In the present practice for a typical feeder with a dimension X=355 mm, Y=50 mm and x=75 mm and y=2 mm above the nip centerline. The lift dY' is found to be 14.2 mm [=(2+1)×(355/75)]. In the present practice, it has been found satisfactory to have the elevator mechanisms for crank 30 and cam 36 operable to maintain the slope angle at an amount of about 6° when the lift is ratioed in accordance with the above expression.

Figure 2:
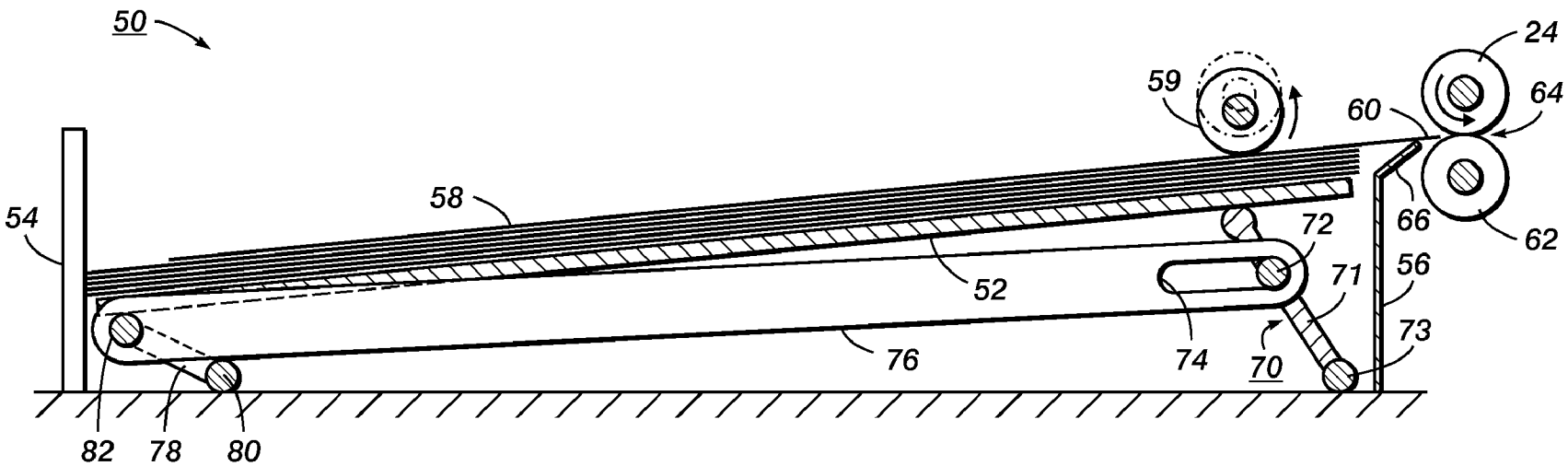
FIG. 2 is a view similar to FIG. 1 of another embodiment of the present disclosure employing a slotted link for connecting the elevator mechanism of the leading edge to a crank for elevating the trailing or opposite edge side of the bed plate.
Figure 3:
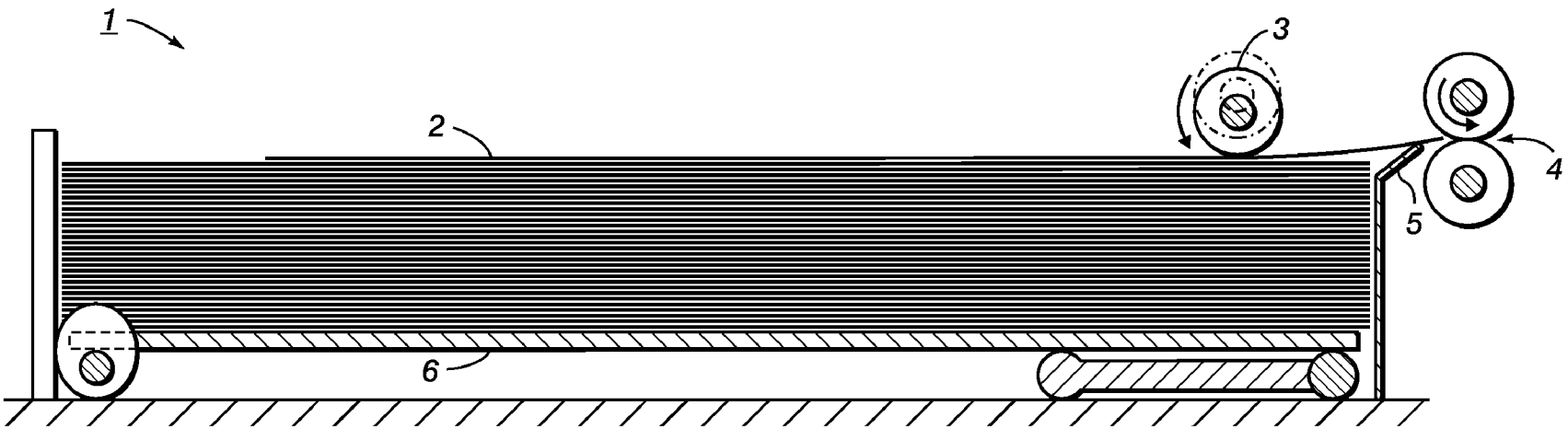
FIG. 3 PRIOR ART
FIG. 3 is a view of a loaded feeder for a prior art device.
Figure 4:
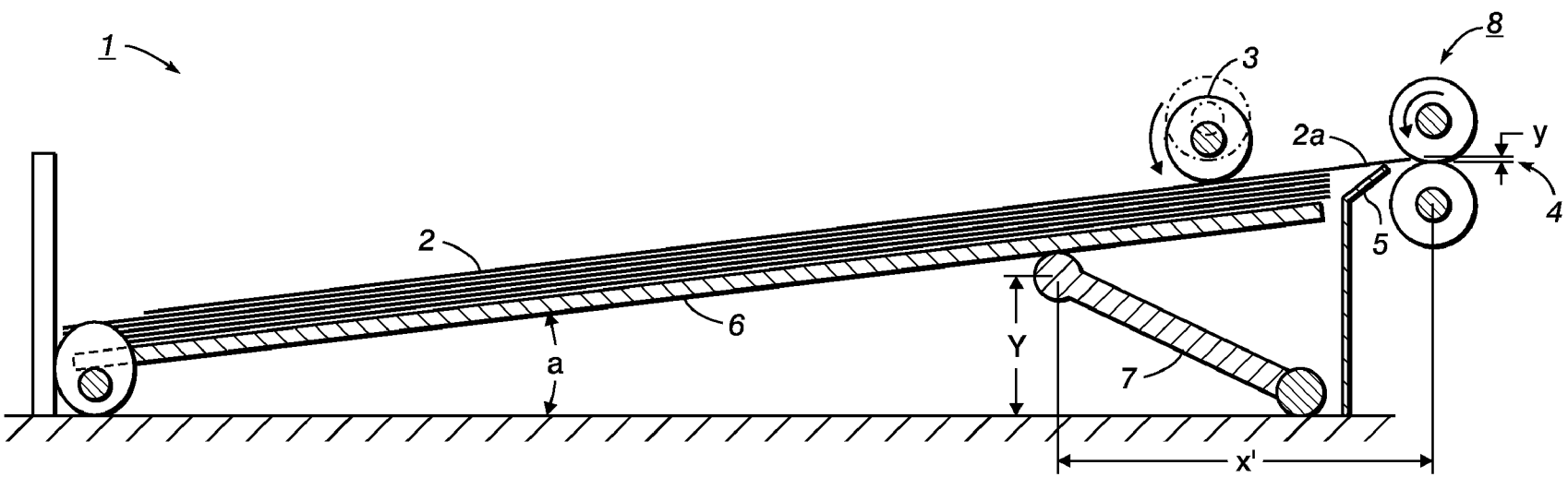
FIG. 4 PRIOR ART
FIG. 4 is a view of the prior art device of FIG. 3 elevated on the leading edge side of the bed plate after significant withdrawal of sheets from the stack.

Referring to FIG. 2, another embodiment of the present disclosure is illustrated in which the feeder has a stack of sheet paper stock indicated generally at 50 disposed on an elevated bed plate or tray 52 with the sides of the stack 50 guided by edge guides denoted 54, 56 for maintaining the stack generally vertically ranged on the bed plate 52.

The top sheet of the stack 58 is shown advanced by nudger rolls 59 such that the leading edge denoted by reference numeral 60 of the sheet 58 is advanced over guide 66 to contact the lower roller 62 of a feeder nip 64.

The edge of the deck plate 52 supporting the leading edge side of stack 50 is elevated by an elevating mechanism 70 comprising crank arm 71 having the lower end pivoted about stationary pin 73 and by a suitable motorized mechanism (not shown). The crank arm 70 has a pin 72 provided thereon which engages a slot 74 in link arm 76 which has the end thereof opposite slot 72 pivotally connected to a pin 82 provided on a secondary crank arm 78 pivoted about stationary pin 80 and positioned such that the upper end of crank arm 78 contacts the trailing or opposite underside of deck plate 52 from the crank arm 70. Thus, as the crank arm 70 is rotated to elevate the leading edge side of the stack, upon the leading edge being elevated to a threshold amount, pin 72 engages the end of slot 74 and causes the link 76 to rotate crank arm 78 and effect lifting of the trailing edge side of the bed plate 52 by the upper end of the arm 78. Thus, the embodiment of FIG. 2 requires only one drive mechanism for the leading edge elevator 70. In the present practice, the embodiment of FIG. 2 provides the advantage that no sensor is required for measuring the amount of lift of the leading edge side of the bed plate in order to determine the point at which the elevator mechanism for the trailing edge side is activated. In the present practice of the invention, when the front or leading edge crank 71 reaches a position corresponding to the feeder tray reaching a critical slope angle, the pin 72 begins to pull the rear crank arm 78 to an upward position. With respect to the embodiment of FIG. 2, it will be understood that changing the position of the link pin 72 on the crank arm 71 will vary the rate of lift on the rear crank 78. For example, locating the attachment point of in 72 on crank arm 71 high on the crank arm enables the trailing crank arm 78 to be engaged at a lower stack height. The additional torque needed to pull the rear crank up is offset by the lower torque needed to lift a reduced stack of paper thereby enabling a smaller elevator lift motor to be employed for the leading edge elevator 70.

The present invention thus provides an apparatus and method for elevating the trailing edge side of a sheet paper feeder so as to maintain proper positioning of the leading edge of the top sheet for contacting the feeder nip of the device into which the paper is being fed such that undue bending and dragging of the next sheet does not occur and misfeeding is prevented. The method and apparatus of the present disclosure are particularly applicable to feeders loaded with heavy weight sheet paper stock as may be employed with photo copiers and printers.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of preventing misfeed from a sheet media feeder/tray into a printer feeder comprising:

(a) progressively raising one side of the sheet stack as sheets are withdrawn and maintaining the leading edge of the top sheet positioned adjacent the feeder entrance; and, (b) raising the opposite side of the sheet stack when the stack slope angle exceeds a predetermined value during sheet withdrawal.

2. The method defined in claim 1, wherein the step of progressively raising includes providing a lifting support for the opposite side of the sheet stack.

3. The method defined in claim 2, wherein the step of raising the opposite side includes linking to the lifting mechanism for the one side.

4. The method defined in claim 1, wherein the step of raising the opposite side includes raising the opposite side to maintain optimum lead edge position into the feeder entrance when the slope angle exceeds a threshold value.

5. A feeder/loader for supplying a sheet media printer feeder comprising:

(a) a support/tray for the sheet media having a mechanism operable for progressively raising one side of the sheet stack for maintaining the leading edge of the top sheet of the stack proximate the entrance of the feeder; and (b) a drive source connected to the sheet stack raising mechanism and operable to raise the opposite side of the sheet stack such that the slope of the stack is maintained at a constant value upon reaching a predetermined value for maintaining the leading edge of the top sheet positioned for proper feeder entry.

6. The feeder/loader defined in claim 5, wherein the drive source for the raising mechanism for the opposite side includes a mechanical linkage to the one side.

7. The feeder/loader defined in claim 5, wherein the raising mechanism includes a cam.

8. Apparatus for preventing misfeed from a sheet media feeder/tray into a printer feeder comprising:

(a) a first mechanism operable to raise one side of the sheet stock as sheets are withdrawn for maintaining the leading edge of the top sheet positioned adjacent the feeder entrance; and, (b) a second mechanism operable to raise the side of the sheet stack opposite the one side when the slope angle due to raising one side exceeds a predetermined value during sheet withdrawal and operable to maintain the slope at a constant value during sheet withdrawal.

9. The apparatus defined in claim 8, wherein the second mechanism includes a mechanical link to the first mechanism.

* * * * *